US005482085A

United States Patent [19]

Wasson

[11] Patent Number: 5,482,085

[45] Date of Patent: Jan. 9, 1996

[54] PILOT PRESSURE SUB-ASSEMBLY FOR FLUID CONTROL VALVE

[75] Inventor: Jeffrey B. Wasson, Circle Pines, Minn.

[73] Assignee: Dana Corporation, Toledo, Ohio

[21] Appl. No.: 956,681

[22] Filed: Oct. 5, 1992

[51] Int. Cl.[6] ..... F15B 13/02

[52] U.S. Cl. ..... 137/625.68; 137/596.1; 137/636.1; 137/868; 251/78; 251/337

[58] Field of Search ..... 137/636.1, 636.2, 137/596.1, 625.68, 868; 251/78, 337

[56] References Cited

U.S. PATENT DOCUMENTS

| | | | |
|---|---|---|---|
| 2,666,452 | 1/1954 | Sheppard et al. . | |
| 3,018,797 | 1/1962 | Parks | 137/627.5 |
| 3,390,943 | 7/1968 | Myers | 137/596.18 X |
| 3,515,441 | 6/1970 | Stein | 137/625.68 X |
| 3,871,537 | 3/1975 | Bernhoft et al. . | |
| 4,184,512 | 1/1980 | Pignolet | 137/868 X |
| 4,445,541 | 5/1984 | Schmiel | 137/636.2 |
| 4,777,981 | 10/1988 | Petro . | |
| 4,827,982 | 5/1989 | Inagaki . | |
| 4,852,852 | 8/1989 | Krieger et al. . | |

FOREIGN PATENT DOCUMENTS 641450 8/1950 United Kingdom .

1549195 7/1979 United Kingdom .

OTHER PUBLICATIONS

Gresen SC–4500 Service And Parts Manual (1990).

*Primary Examiner*—Gerald A. Michalsky
*Attorney, Agent, or Firm*—MacMillan, Sobanski & Todd

[57] ABSTRACT

A fluid control valve includes a spring biased pilot pressure sub-assembly for adjustably setting an initial step pressure. The sub-assembly includes a spring seat and an axially movable spool. The spool includes a body portion having a threaded outer surface. A pair of lock nuts are threaded on the threaded body portion. A pilot spring reacts between the lock nuts and the spring seat. The magnitude of the initial step pressure is dependent upon the magnitude of the force exerted by this pilot spring. The magnitude of this force can be adjusted by changing the position of the lock nuts relative to the spring seat. Because they are threaded onto the spool, rotation of the lock nuts causes axial movement relative thereto. Thus, the position of the lock nuts on the spool can be adjusted simply by rotating them relative to the spool. Such axial movement can be performed to increase or decrease (depending upon the direction of rotation) the effective length of the pilot spring and, therefore, the spring force generated thereby. As a result, the magnitude of the initial step pressure increase can be adjusted quickly and easily.

17 Claims, 3 Drawing Sheets

PILOT PRESSURE SUB-ASSEMBLY FOR FLUID CONTROL VALVE

BACKGROUND OF THE INVENTION

This invention relates in general to fluid control valves and in particular to an improved structure for a spring biased pilot pressure sub-assembly for such a fluid control valve.

In many hydraulic and pneumatic systems, control valves are provided for regulating the flow of fluid from a pressurized source to one or more controlled devices. Fluid control valves of this type generally include a case having a plurality of ports formed therein. A pressure port is provided which communicates with the pressurized source, while a tank port is provided which communicates with a fluid reservoir. One or more work ports are also provided which communicate with respective controlled devices. By selectively providing communication between the various ports, the operation of the controlled devices can be regulated in a desired manner.

For each of the work ports, a plunger valve assembly is typically provided within the case of the fluid control valve. Each of the plunger valve assemblies is operable to selectively provide communication between its associated work port and each of the pressure and tank ports. This is usually accomplished by means of an axially movable spool contained within the plunger valve assembly. The spool is movable upwardly and downwardly between opened and closed positions. In the opened position, the spool permits communication between the associated work port and the pressure port, thereby causing actuation of the controlled device. In the closed position, the spool provides communication between the associated work port and the tank port, thereby preventing actuation of the controlled device.

Axial movement of the spools is usually accomplished by means of a pivotable lever which is mounted on the upper end of the case. The lever is connected through respective linkages to each of the plunger valve assemblies. The lever is usually biased toward a center position. Pivoting movement of the lever in a first direction from the center position causes downwardly movement of one of the spools from the closed position to the opened position. Similarly, pivoting movement of the lever in a second direction from the center position causes downwardly movement of the other of the spools from the closed position to the opened position. The spools are usually biased upwardly by respective return springs toward the closed positions. These return springs typically react between spring seats formed on the case and portions of the associated linkages. As a result, an affirmative effort is required to pivot the lever from the center position so as to move the spools from their closed positions to their opened positions.

In fluid control valves of this type, it is often desirable to provide a mechanism whereby the lever can be pivoted within a limited range of movement from the center position without opening either of the plunger valve assemblies. This "dead band" range of lever pivoting movement is relatively small, plus or minus two degrees from the center position, for example. The purpose of the "dead band" range of movement is to prevent small movements of the lever from causing unintended movements of the spools and, therefore, operation of the controlled devices. Once the lever has been pivoted beyond the end of the "dead band" range, the spool is moved from the closed position to the opened position. When this occurs, there is a step increase in the magnitude of the fluid pressure supplied to the controlled device, from zero pressure to a predetermined initial step pressure. Further pivoting movement of lever causes a generally linear increase in the magnitude of the fluid pressure supplied to the controlled device from the initial step pressure to the maximum available system pressure.

To accomplish this "dead band" operation, it is known to provide a spring or similar resilient member in the linkage between the lever and each of the spools of the plunger valves. These springs (generally referred to as pilot springs) typically react between spring seats formed on the spools and portions of the associated linkages. Thus, when the lever is pivoted, the spool is not directly contacted so as to be moved downwardly to the opened position. Rather, the spool is biased by the pilot spring so as to be urged downwardly toward the opened position. The magnitude of the force exerted by the pilot spring determines the magnitude of the step increase in pressure discussed above. In other words, the magnitude of the initial step pressure is dependent upon the magnitude of the force exerted by the pilot spring. This spring biased structure for setting the initial step pressure is referred to as a pilot pressure sub-assembly for the fluid control valve.

The desired magnitude of the initial step pressure can vary from application to application for the fluid control valve. To accommodate this, means are usually provided in known pilot pressure sub-assemblies for adjusting the magnitude of the force exerted by the pilot spring. As mentioned above, the pilot springs typically react between spring seats formed on the spools and portions of the associated linkages. In the past, the adjustment of the force exerted by the pilot spring was accomplished by inserting and removing annular shims provided on the spring seats. By inserting and removing these shims, the distance separating the ends of the pilot spring (and, therefore, the spring force generated thereby) could be varied. While this method is effective, it has been found to be very time consuming. Also, it has been found to be difficult to accurately obtain a desired spring force. Accordingly, it would be desirable to provide an improved structure for a spring biased pilot pressure sub-assembly for a fluid control valve in which the force exerted by the pilot spring can be adjusted quickly and easily.

SUMMARY OF THE INVENTION

This invention relates to a fluid control valve including an improved structure for a spring biased pilot pressure sub-assembly for adjustably setting an initial step pressure. The sub-assembly includes a spring seat and an axially movable spool. The spool includes a body portion having a threaded outer surface. A pair of lock nuts are threaded on the threaded body portion. A pilot spring reacts between the lock nuts and the spring seat. The magnitude of the initial step pressure is dependent upon the magnitude of the force exerted by this pilot spring. The magnitude of this force can be adjusted by changing the position of the lock nuts relative to the spring seat. Because they are threaded onto the spool, rotation of the lock nuts causes axial movement relative thereto. Thus, the position of the lock nuts on the spool can be adjusted simply by rotating them relative to the spool. Such axial movement can be performed to increase or decrease (depending upon the direction of rotation) the effective length of the pilot spring and, therefore, the spring force generated thereby. As a result, the magnitude of the initial step pressure increase can be adjusted quickly and easily.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
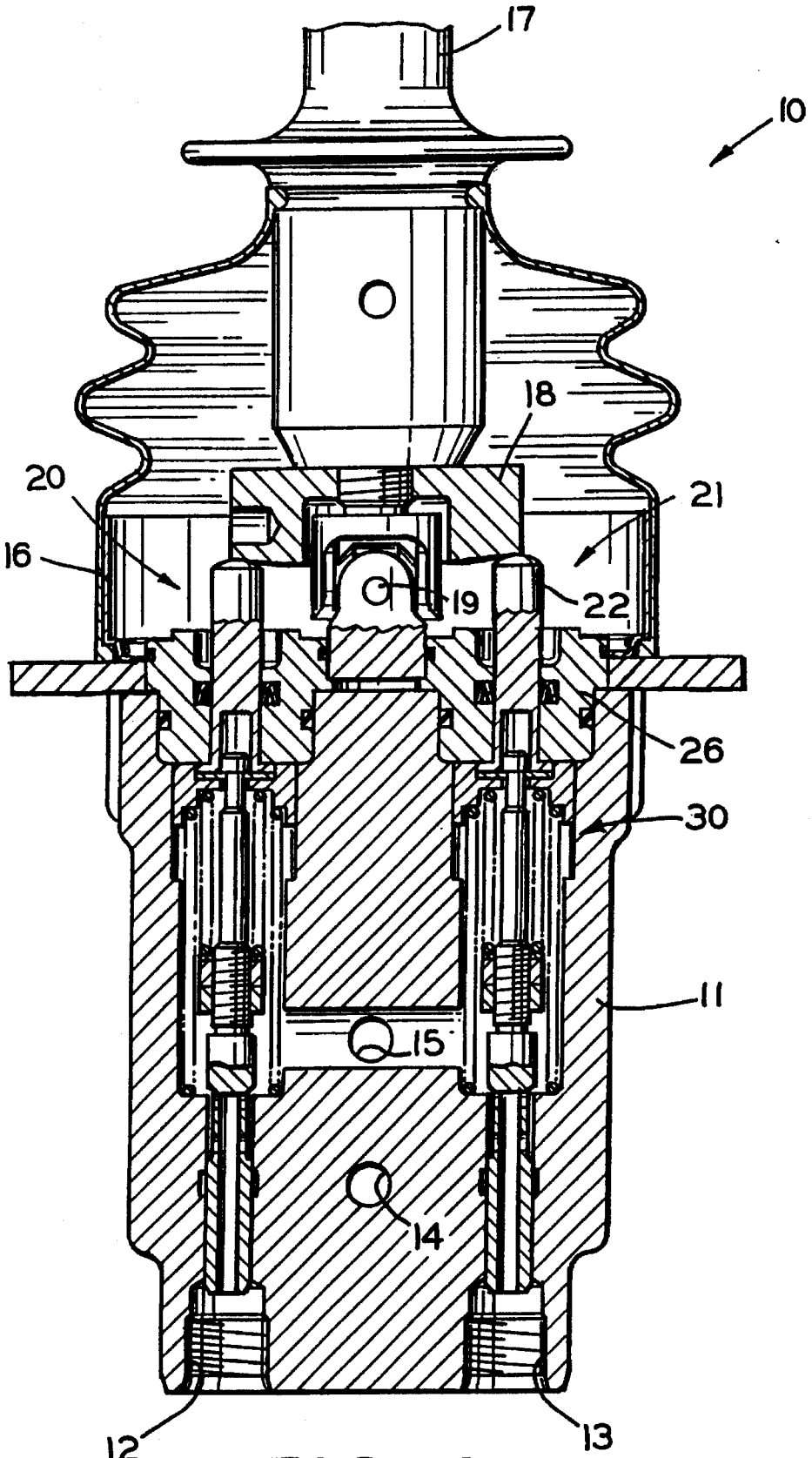
FIG. 1 is an elevational view, partially in cross section, of a fluid control valve including a spring biased pilot pressure sub-assembly in accordance with this invention.

Referring now to the drawings, there is illustrated in FIG. 1 a fluid control valve, indicated generally at 10, in accordance with this invention. The control valve 10 includes a lower case portion 11 having first and second work ports 12 and 13 formed therein. The work ports 12 and 13 are adapted to communicate with respective fluid controlled devices (not shown) in a manner which is well known in the art. Also, a pressure port 14 and a tank port 15 are provided in the lower case portion 11. The pressure port 14 is adapted to communicate with a source of pressurized fluid (not shown), while the tank port 15 is adapted to communicate with a fluid tank or reservoir (not shown), again in a manner which is well known in the art.

The control valve 10 further includes an upper end portion 16 which is disposed co-axially above the lower case portion 11. The control valve 10 is operated by a lever 17 having a base portion 18 secured thereto. The base portion 18 of the lever 17 is pivotably secured relative to the upper end portion 16 by a pivot pin 19. Thus, the lever 17 and the base portion 18 are capable of being pivoted clockwise and counter-clockwise relative to the upper end portion 16.

First and second plunger assemblies, indicated generally at 20 and 21, are mounted within the upper end portion 16 of the control valve 10. The first and second plunger assemblies 20 and 21 are identical in structure and operation. The first and second plunger assemblies 20 and 21 control the operation of the controlled devices communicating with the first and second work ports 12 and 13 respectively. Because of their similarity, only the structure of the second plunger assembly 21 (which is associated with the work port 13) will be discussed herein.

The second plunger assembly 21 includes a plunger member 22 which is axially movable upwardly and downwardly within the control valve 10. The upper end of the plunger member 22 abuts the lower surface of one end of the base portion 18 of the lever 17. Thus, pivoting movement of the lever 17 in a clockwise direction from the illustrated center position causes downward movement of the plunger member 22. If desired, the plunger member 22 may be journalled for axial movement within a conventional detent mechanism (not shown) mounted within the upper end portion 16. The lower end of the plunger member 22 is journalled for upward and downward axial movement in an annular transition member 26. The transition member 26 is secured between the upper end portion 16 and the lower case portion 11. The structure of the control valve 10 thus far described is conventional in the art.

Figure 2:
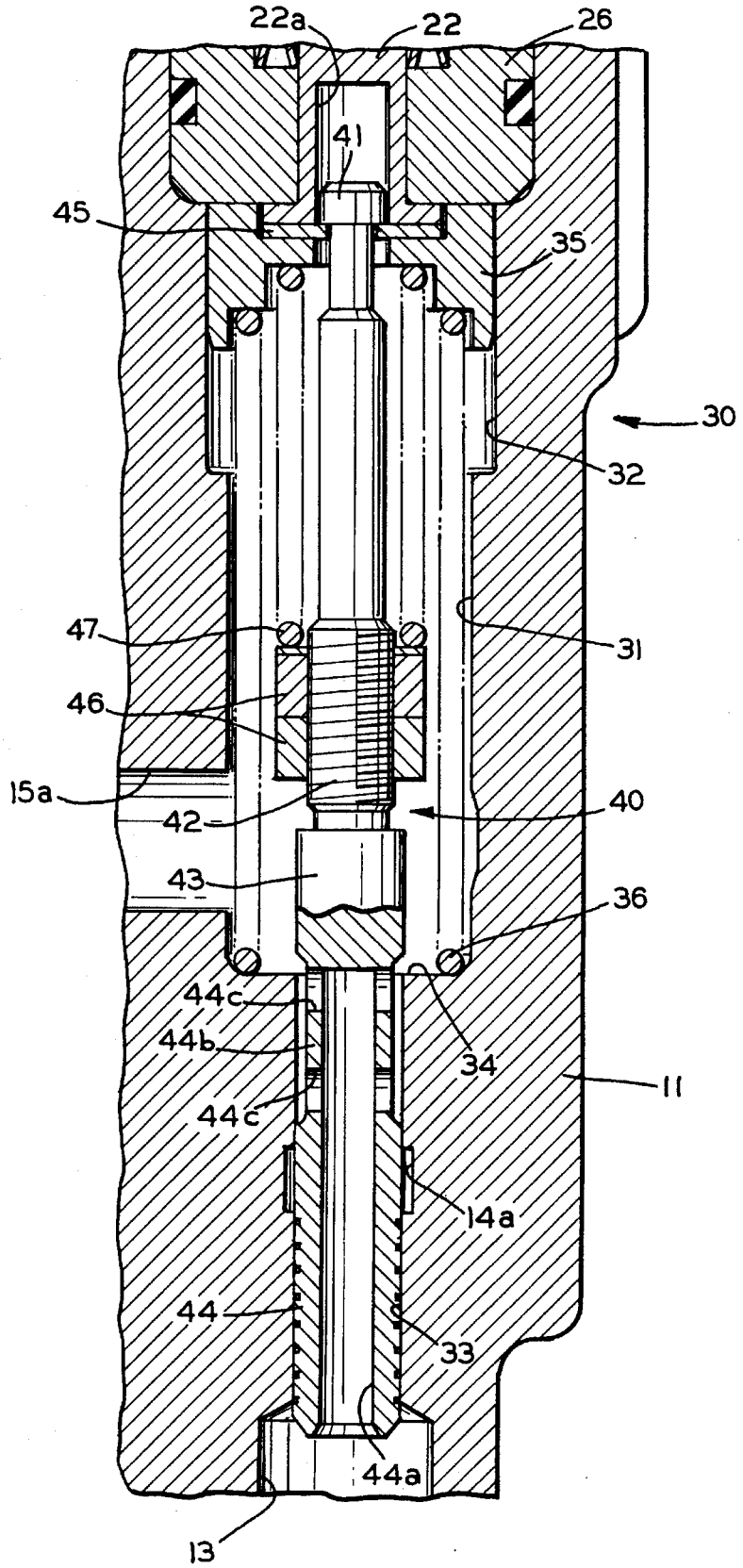
FIG. 2 is an enlarged view of the spring biased pilot pressure sub-assembly illustrated in FIG. 1, wherein the spool is shown in a closed position.

Referring now to FIG. 2, there is illustrated in detail a pilot pressure sub-assembly, indicated generally at 30, which is mounted within a bore 31 formed in the lower end of the lower case portion 11. As discussed above, the pilot pressure sub-assembly 30 is provided for setting the initial step pressure when the lever 17 of the control valve 10 is pivoted clockwise beyond the "dead band" range. The bore 31 is formed having a larger diameter upper portion 32 and a smaller diameter lower portion 33, thus defining a stepped shoulder 34 therebetween. The pilot pressure sub-assembly 30 includes an annular spring seat 35. The spring seat 35 is disposed in the upper bore portion 32 of the bore 31 adjacent to the lower end of the transition member 26 and to the lower end of the plunger member 22 extending through the transition member 26. A return spring 36 reacts between the stepped shoulder 34 and the spring seat 35, thus urging the spring seat 35 and the plunger member 22 upwardly within the bore 31.

The pilot pressure sub-assembly 30 further includes a spool, indicated generally at 40, which is axially movable upwardly and downwardly within the bore 31. The spool 40 includes an upper head portion 41, an elongated body portion 42, an enlarged valve seat portion 43, and a lower spool portion 44. The head portion 41 is disposed within the upper bore portion 32 and extends through the annular spring seat 35 into a recess **22*a* formed in the lower end of the plunger member 22. A two-piece split washer 45 is disposed between the lower end of the plunger member 22 and the upper end of the spring seat 35. The split washer 45 defines an inner diameter which is smaller in diameter than the head portion 41 of the spool 40. Thus, because the return spring 36 urges the spring seat 35 upwardly within the upper bore portion 32, the split washer 45 and the spool 40 are also urged upwardly. However, such upward movement is limited by the engagement of the spring seat 35 with the transition member 26**.

A portion of the outer surface of the body portion 42 of the spool 40 is threaded, and a pair of lock nuts 46 are threaded thereon. A pilot spring 47 reacts between the lock nuts 46 and the spring seat 35, thus urging the spool 40 downwardly relative to the spring seat 35. Thus, under the upward urging of the return spring 36 and the downward urging of the pilot spring 47, the spool 40 is normally maintained in the closed position shown in FIG. 2. In that closed position, the valve seat portion 43 of the spool 40 is axially spaced apart from the lower bore portion 33 of the bore 31. As a result, fluid communication is permitted between the upper bore portion 32 and the lower bore portion 33. Therefore, a passageway **15*a* communicating with the tank port 15 communicates with the upper bore portion 32 and the lower bore portion 33, as shown in FIG. 2**.

The lower spool portion 44 of the spool 40 is disposed within the lower bore portion 33 of the bore 31. The lower spool portion 44 is hollow, defining an internal passageway **44*a* which communicates with the work port 13. The lower spool portion 44 has a smaller diameter recessed area 44*b* formed therein which extends from downwardly from the valve seat portion 43. A plurality of radially extending bores 44*c* are formed through the recessed area 44*b* of the lower spool portion 44. The bores 44*c* provide for fluid communication between the internal passageway 44*a* and the annular space surrounding the recessed area 44*b***.

The operation of the pilot pressure sub-assembly 30 will now be explained. When the lever 17 is in the center neutral position illustrated in FIG. 1, the plunger member 22 is positioned in abutment with the transition member 26 under the urging of the return spring 36. As a result, the spool 40 is maintained in the closed position shown in FIG. 2. In this closed position, the valve seat portion 43 of the spool 40 is axially spaced apart from the lower bore portion 33 of the bore 31, as mentioned above. As a result, fluid communication is permitted between the upper bore portion 32 and the lower bore portion 33. Thus, the upper bore portion 32 and the lower bore portion 33 are vented to the tank through the passageway 15*a* and the tank port 15. Also, in the closed position, the lower spool portion 44 of the spool 40 extends over a passageway 14*a* communicating with the pressure port 14. Consequently, no pressurized fluid from the pressure source is permitted to flow to the work port 13.

When it is desired to operate the controlled device connected to the work port 13, the lever 17 is pivoted clockwise from the center position. As discussed above, such pivoting movement causes the plunger member 22 to be moved downwardly. Because of the engagement of the plunger member 22 with the split washer 45 and the spring seat 35, the spring seat 35 is also moved downwardly against the urging of the both the return spring 36 and the pilot spring 47. Since the pilot spring 47 reacts against the lock nuts 46 threaded onto the body portion 42 of the spool 40, an increasing magnitude of force is exerted to urge the spool 40 downwardly within the bore 31. Inasmuch as there is little resistance to such downward movement, the spool 40 moves downwardly with the pivoting movement of the lever 17.

Figure 3:
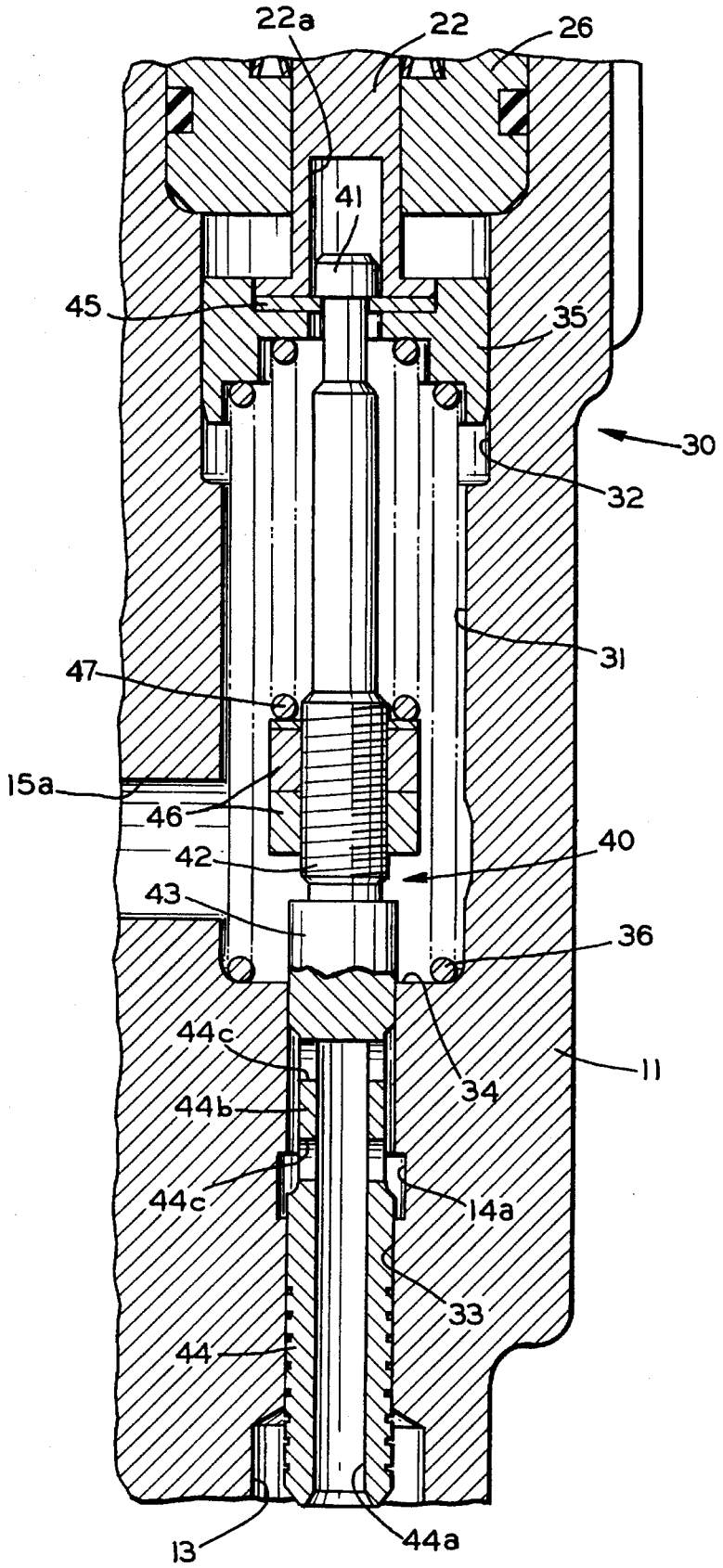
FIG. 3 is an enlarged view of the spring biased pilot pressure sub-assembly similar to FIG. 2, wherein the spool is shown in a opened position.

When the spool 40 has been moved downward a sufficient distance, it will be moved to the opened position shown in FIG. 3. As shown therein, the valve seat portion 43 of the spool 40 is received within the lower bore portion 33 of the bore 31. Thus, fluid communication is no longer permitted between the lower bore portion 33 and the upper bore portion 32. At the same time, the smaller diameter recessed area 44*b* of the lower spool portion 44 is moved into communication with the passageway 14*a* and, therefore, the pressure port 14. Pressurized fluid from the pressure port 14 can then flow from the passageway 14*a* upwardly through the recessed area 44*b*, inwardly through the radial bores 44*c*, and downwardly through the internal passageway 44*a* to the work port 13. Thus, the fluid pressure in the work port 13 is immediately increased from zero pressure to an initial step pressure to operate the controlled device connected to the work port 13.

The magnitude of this initial step pressure increase is dependent upon the magnitude of the force exerted by the pilot spring 47. As is well known, the force exerted by a given spring is proportional to the length thereof (i.e., the distance separating the ends of such spring) Thus, in the pilot pressure sub-assembly, it is the length of the pilot spring 47 which determines the magnitude of the initial step pressure increase when the spool 40 is moved from the closed position to the opened position.

As shown in FIGS. 2 and 3, the pilot spring 47 reacts between the spring seat 35 and the lock nuts 46. As mentioned above, the lock nuts 46 are threaded onto the body portion 43 of the spool 40. Thus, the position of the lock nuts 46 on the body portion 43 can be adjusted simply by rotating them relative to the spool 40. Thus, the lock nuts 46 function as an adjustable spring seat on the spool 40. Because they are threaded onto the body portion 43, rotation of the lock nuts 46 causes axial movement relative to the spool 40. Such axial movement can be performed to increase or decrease (depending upon the direction of rotation) the effective length of the pilot spring 47 and, therefore, the spring force generated thereby. As a result, the magnitude of the initial step pressure increase can be adjusted quickly and easily. Furthermore, such an arrangement provides an infinite range of adjustments, as opposed to shims which provide for adjustments in discrete steps defined by the thicknesses thereof.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A control valve comprising:

a case including a first port, a second port, and a bore which is capable of providing communication between said first and second ports;

plunger means having at least a portion disposed within said bore for movement between first and second plunger means positions;

a spool disposed within said bore for movement between a closed position, wherein fluid communication is prevented between said first and second ports, and an opened position, wherein fluid communication is permitted between said first and second ports;

a spool spring seat mounted on said spool;

cooperating means formed on said spool and said spool spring seat and responsive to relative movement therebetween for adjustably positioning said spool spring seat on said spool at a desired location; and a spring reacting between said plunger means and said spool spring seat for urging said spool from said closed position to said opened position when said plunger means is moved from said first plunger means position to said second plunger means position.

2. The control valve defined in claim 1 further including a lever mounted on said case for pivoting movement between first and second lever positions, a portion of said plunger means engaging a portion of said lever for movement therewith between said first and second plunger means positions, respectively.

3. The control valve defined in claim 1 wherein said means for adjustably positioning said spool spring seat on said spool is infinitely adjustable.

4. The control valve defined in claim 1 wherein said means for adjustably positioning said spool spring seat on said spool includes mating threaded portions formed on said spool spring seat and said spool.

5. The control valve defined in claim 4 wherein threaded portion of said spool spring seat is an inner threaded surface and wherein threaded portion of said spool is an outer threaded surface.

6. The control valve defined in claim 5 wherein said spool spring seat is a lock nut threaded onto said spool.

7. The control valve defined in claim 5 wherein said spool spring seat is a pair of lock nuts threaded onto said spool.

8. The control valve defined in claim 1 wherein said plunger means includes a plunger member and a plunger spring seat engaged with said plunger member, said spring reacting between said plunger spring seat and said spool spring seat.

9. A fluid control valve comprising:

a case including a pressure port adapted to communicate with a source of pressurized fluid, a tank port adapted to communicate with a reservoir of fluid, a work port adapted to communicate with a controlled device, and a bore which is capable of providing communication between said work port and each of said pressure port and said tank port;

plunger means having at least a portion disposed within said bore for movement between first and second plunger means positions;

a spool disposed within said bore for movement between a closed position, wherein fluid communication is permitted between said work port and said tank port, and an opened position, wherein fluid communication is permitted between said work port and said pressure port;

a spool spring seat mounted on said spool;

cooperating means formed on said spool and said spool spring seat and responsive to relative movement therebetween for adjustably positioning said spool spring seat on said spool at a desired location; and a spring reacting between said plunger means and said spool spring seat for urging said spool from said closed position to said opened position when said plunger means is moved from said first plunger means position to said second plunger means position.

10. The fluid control valve defined in claim 9 further including a lever mounted on said case for pivoting movement between first and second lever positions, a portion of said plunger means engaging a portion of said lever for movement therewith between said first and second plunger means positions, respectively.

11. The fluid control valve defined in claim 9 wherein said means for adjustably positioning said spool spring seat on said spool is infinitely adjustable.

12. The fluid control valve defined in claim 9 wherein said means for adjustably positioning said spool spring seat on said spool includes mating threaded portions formed on said spool spring seat and said spool.

13. The fluid control valve defined in claim 12 wherein threaded portion of said spool spring seat is an inner threaded surface and wherein threaded portion of said spool is an outer threaded surface.

14. The fluid control valve defined in claim 13 wherein said spool spring seat is a lock nut threaded onto said spool.

15. The fluid control valve defined in claim 13 wherein said spool spring seat is a pair of lock nuts threaded onto said spool.

16. The fluid control valve defined in claim 9 wherein said plunger means includes a plunger member and a plunger spring seat engaged with said plunger member, said spring reacting between said plunger spring seat and said spool spring seat.

17. A control valve comprising:

a case including a first port, a second port, and a bore which is capable of providing communication between said first and second ports;

plunger means having at least a portion disposed within said bore for movement between first and second plunger means positions;

a spool disposed within said bore for movement between a closed position, wherein fluid communication is prevented between said first and second ports, and an opened position, wherein fluid communication is permitted between said first and second ports, said spool having an outer threaded surface;

a first nut threaded onto said threaded outer surface of said spool and disposed at a predetermined location relative thereto;

a second nut threaded onto said threaded outer surface of said spool and engaged with said first nut so as to retain it at said predetermined location; and a spring reacting between said plunger means and said first nut for urging said spool from said closed position to said opened position when said plunger means is moved from said first plunger means position to said second plunger means position.

* * * * *